US009611594B2

(12) United States Patent
van Balen

(10) Patent No.: US 9,611,594 B2
(45) Date of Patent: Apr. 4, 2017

(54) ARTIFICIAL LAWN

(75) Inventors: Jeroen Albert van Balen, Köln (DE); Menno van Dijk, legal representative, Hengelu (NL)

(73) Assignee: Ten Cate Nederland B.V. (NL)

( * ) Notice: Subject to any disclaimer, the term of this patent is extended or adjusted under 35 U.S.C. 154(b) by 660 days.

(21) Appl. No.: 13/992,436

(22) PCT Filed: Dec. 8, 2011

(86) PCT No.: PCT/NL2011/050841

§ 371 (c)(1),
(2), (4) Date: Feb. 3, 2014

(87) PCT Pub. No.: WO2012/105827

PCT Pub. Date: Aug. 9, 2012

(65) Prior Publication Data

US 2014/0295111 A1 Oct. 2, 2014

(30) Foreign Application Priority Data

Dec. 9, 2010 (NL) ..... 2005847

(51) Int. Cl.
*E01C 13/08* (2006.01)
*D05C 17/02* (2006.01)
*D06N 7/00* (2006.01)

(52) U.S. Cl.
CPC ..... *E01C 13/08* (2013.01); *D05C 17/023* (2013.01); *D06N 7/0071* (2013.01); *Y10T 29/49826* (2015.01); *Y10T 428/23979* (2015.04); *Y10T 428/24479* (2015.01)

(58) Field of Classification Search
CPC .... E01C 13/08; D05C 17/023; D06N 7/0071; Y10T 428/23979
USPC ..... 428/17, 95
See application file for complete search history.

(56) References Cited

U.S. PATENT DOCUMENTS 4,389,435 A * 6/1983 Haas, Jr. ..... B32B 5/24 428/17
6,955,841 B2 * 10/2005 Weghuis ..... E01C 13/08 428/15
8,283,016 B2 * 10/2012 Slootweg ..... D01D 5/247 428/17
8,465,813 B2 * 6/2013 Slootweg ..... D01D 5/247 428/17

(Continued)

FOREIGN PATENT DOCUMENTS

CA 2122924 A1 * 5/1993 ..... D04H 11/08
CH EP 1696077 A1 * 8/2006 ..... E01C 13/08

(Continued)

OTHER PUBLICATIONS

International Search Report, PCT Application No. PCT/NL2011/050841, mailed Jun. 22, 2012.

(Continued)

*Primary Examiner* — Cheryl Juska
(74) *Attorney, Agent, or Firm* — Kilpatrick Townsend & Stockton LLP

(57) ABSTRACT

Artificial lawn, in particular an artificial grass sports field, comprising a substrate as well as artificial fibers extending from said substrate, whereby the substrate is formed such that it extends between the artificial grass fibers.

20 Claims, 6 Drawing Sheets

(56) References Cited

U.S. PATENT DOCUMENTS

| | | | | |
|---|---|---|---|---|
| 8,557,363 | B2 * | 10/2013 | Van Balen | E01C 13/08 139/2 |
| 2004/0247902 | A1 * | 12/2004 | Chuang | B32B 21/04 428/457 |
| 2008/0176010 | A1 * | 7/2008 | Sawyer | E01C 13/02 428/27 |
| 2008/0260974 | A1 * | 10/2008 | Morton-Finger | D01D 5/24 428/17 |
| 2008/0292812 | A1 * | 11/2008 | Ramm | C23C 8/36 427/570 |
| 2009/0162578 | A1 * | 6/2009 | Van Balen | E01C 13/08 428/17 |
| 2009/0252900 | A1 * | 10/2009 | Slootweg | D01D 5/247 428/17 |
| 2010/0021660 | A1 * | 1/2010 | Slootweg | D01D 5/247 428/17 |
| 2015/0167255 | A1 * | 6/2015 | Van Balen | E01C 13/08 428/27 |

FOREIGN PATENT DOCUMENTS

| | | | | |
|---|---|---|---|---|
| DE | WO 2012105827 | A1 * | 8/2012 | E01C 13/08 |
| GB | 0430808 | A | 4/1976 | |
| IT | WO 2008072073 | A2 * | 6/2008 | E01C 13/08 |
| JP | 01-215537 | A | 8/1989 | |
| JP | 07329210 | A * | 12/1995 | |
| JP | 11-93112 | A | 4/1999 | |
| JP | 11-172615 | A | 6/1999 | |
| JP | 2004-225488 | A | 8/2004 | |
| JP | 2008/150844 | A | 3/2008 | |
| JP | 2009-052200 | A | 3/2009 | |
| KR | 20080032967 | A * | 4/2008 | |
| NL | WO 2013183989 | A1 * | 12/2013 | E01C 13/08 |
| WO | 93/09294 | A1 | 5/1993 | |
| WO | 01/96664 | A1 | 12/2001 | |
| WO | 2004/057111 | A1 | 7/2004 | |
| WO | 2009/011569 | A1 | 1/2009 | |

OTHER PUBLICATIONS

Office Action, Chinese Patent Application No. 2011800670370, mailed Dec. 10, 2015.

Office Action, Japanese Patent Application No. 2013-543123, mailed Nov. 4, 2015.

* cited by examiner

ARTIFICIAL LAWN

PRIOR RELATED APPLICATIONS

This application is a National Phase application of International Application No. PCT/NL2011/050841 filed Dec. 8, 2011, which claims priority to Netherlands Patent Application No. 2005847 filed Dec. 9, 2010, each of which are incorporated herein by reference in their entirety.

The invention relates to an artificial lawn, in particular an artificial grass sports field, comprising a substrate as well as artificial fibres extending from said substrate.

The invention further relates to a substrate intended for use in an artificial lawn according to the invention.

The invention also relates to a method for producing a substrate according to the invention, as well as to a device for producing a substrate element for forming an artificial lawn according to the invention.

An artificial lawn as referred to above is known, for example from NL 1015451.

Many sports, such as field hockey, tennis, American football etc are currently played on artificial grass sports fields as described in the introduction.

Although sporters sustain fewer injuries on natural grass sports fields when falling, making sliding tackles etc, on account of the softer surface thereof, such sports fields are often damaged in particular when the above sports are played thereon, precisely because they are used intensively and because of the varying influence of the weather conditions.

Artificial grass sports fields, on the other hand, require less maintenance and can be played much more intensively than natural grass sports fields. In order to come as close to the playing characteristics of natural grass sports fields as possible on an artificial grass sports field, a thick layer of a granular infill, such as sand or plastic granules, is provided between the synthetic grass fibres in the current artificial lawn systems. Said thick layer of infilled granules not only provides a softer, damping and thus less injury-prone playing surface, but it also leads to better playing characteristics.

The use of a thick layer of granular material in artificial grass sports fields has a number of drawbacks. A considerable layer of granular material is needed, in current artificial lawns between 2.5 and 5.5 cm of material is infilled. Not only is the installation of such an artificial grass sports field more labour-intensive than the installation of a natural grass sports field, but an infilled artificial grass sports field requires maintenance also after it has been installed. The initially uniform distribution of the thick layer of granular infill material can be upset by intensive usage. As a result, areas containing hardly any infill may form in the artificial grass sports field, in particular in places where the field is played on very intensively, for example in the goal area, which has an adverse effect on the quality of play and which leads to an increased risk of injury. The amount of granular material and the distribution thereof in an infilled artificial grass sports field must be checked regularly and repairs must be carried out, if necessary.

The use of a granular infill material on the one hand leads to improved playing characteristics of the artificial grass system, but on the other hand it also leads to a more complex structure of the artificial lawn, so that its installation and maintenance are more labour-intensive than in the case of a artificial lawn not provided with such a granular infill material.

It has also been found that weather conditions have an adverse effect on the material properties of the infill material with the passage of time, resulting in a deterioration of the quality of the infill material and thus of the playing characteristics of the artificial grass sports field. An adverse effect is, for example, the drastic compacting of the infill material, as a result of which the artificial grass sports field will feel harder and harder during use, with an increased risk of injuries. Furthermore, the plastic infill material may change (hard or become brittle) under the influence of the weather conditions (sunlight, for example).

It is an object of the invention to provide an improved artificial lawn which will exhibit constant, natural playing characteristics over time and which is easy to install and maintain. This object is accomplished with an artificial lawn according to the invention, in which the substrate is formed such that it extends between and along the artificial grass fibres.

An artificial lawn exhibiting such a feature has the surprising effect that the substrate also exhibits damping characteristics such that the artificial lawn exhibits natural playing characteristics and the addition of a considerable amount of granular infill material is no longer necessary. Thus, a small amount of granular infill material will suffice, which on the one hand is appealing for aesthetic and psychological reasons and which on the other hand enables the players to optimise their play, in particular as far as sliding tackles are concerned. As a result of the substantial reduction of the amount of infill material, an artificial lawn is realised which is easier to install, to maintain and to remove, and which exhibits constant, natural playing characteristics.

In another embodiment, the substrate has a first side, to which the artificial grass fibres are attached, and a second side, on which protrusions extend in the direction of free ends of the artificial grass fibres between and along said artificial grass fibres.

The first side is understood to be the side via which the substrate is supported on the stable sport-technical base. The second side is understood to be the opposite side, on which the sport is practised and which is thus in contact with the players. The artificial grass fibres are attached to the first/bottom side of the substrate and extend through the substrate in the direction of the second side. On said second side, the artificial grass fibres extend to a specific height.

In one embodiment, the artificial grass fibres are provided in the substrate by means of a tufting technique and fixed in place/bonded to the substrate by means of an ultrasonic welding technique or a powder or latex coating technique. This enhances the durability of the field and prevents artificial grass fibres from becoming detached from the substrate as a result of intensive use of the field.

Other methods (other than by means of a tufting technique) of providing the artificial grass fibres in the substrate, among which stitching, are also possible, however.

In yet another embodiment, the protrusions have a round cross-section, in particular a cylindrical or ellipsoidal cross-section, and/or the protrusions have a cross-section which is polygonal in shape. The free ends of the protrusions may be rounded in that case.

Protrusions having a round cross-section, for example a circular or ellipsoidal cross-section, have the advantage that forces exerted thereon during play can be distributed more evenly and be diverted to the base. This has a positive effect on the life of the substrate and reduces the risk of injury to the players. In addition to that, a round cross-section of the protrusions has the advantage that this enables the protrusions to move more freely between the artificial grass fibres, thereby achieving a better damping effect. This reduces the occurrence of injuries.

Polygonal protrusions provide a more static (stiffer) substrate, thereby achieving a greater durability of the substrate and locally realising a "harder" playing field. Several protrusions can be combined so as to realise locally desired characteristics of the artificial lawn.

In another embodiment, the substrate is made from a polymer, in particular a thermoplastic, an elastomer or a thermoplastic elastomer.

The use of a thermoplastic material for the substrate has the advantage that this makes the substrate easier to produce. Thermoplastic material is are easy to produce at relatively low cost and they are versatile in use. The use of an elastomer may result in better shock-absorbing characteristics of the substrate. A practical embodiment of the substrate may be made of a foamed or non-foamed material which has thermoplastic as well as elastomeric material characteristics, or which is made from rubber, for example.

In another embodiment, the substrate is provided with recesses extending into the substrate at the location where the artificial grass fibres are attached. Usually, the artificial grass fibres attached to the substrate project on the first side. The presence of the artificial grass fibre loops leads to a difference in height, which may or may not be small, as a result of which said artificial grass fibre loops can break due to interaction (friction/abrasion) with the sport-technical base, so that the fibres will be loosely held in the substrate and can more easily become detached, therefore.

Because of the presence of the recesses, in which the artificial grass fibres, at least their connections with the substrate, are accommodated, the artificial grass fibre loops are not longer subjected to loads, as a result of which they will no longer break.

In yet another embodiment, the substrate comprises drainage channels extending through the substrate for the drainage of water from the artificial lawn. Rain water that precipitates on the artificial lawn will have to be drained so as to prevent water puddles forming on the artificial lawn. The drainage of the rainwater can be realised by laying the artificial lawn at a certain slope relative to the base, such that the lawn slopes down from the centre thereof. On the other hand, the artificial lawn may be provided with a drainage system consisting of drainage channels which extend through the sport-technical layer under the lawn.

Providing such drainage channels in the substrate has the advantage that the rainwater will be discharged to the subgrade more quickly. This has a positive effect on the playing characteristics of the artificial lawn.

In another embodiment, the substrate is configured as or built up of several interconnectable substrate elements. This makes it possible to transport the substrate in parts and assemble the various substrate elements locally (in the sports park or stadium). The dimensions of each substrate element can be selected so that the lawn will be easier to handle and thus to install.

The dimensions may also be selected with a view to optimising the transport of the substrate elements. For example because the substrate elements are adapted to the dimensions of a sea container. The substrate elements may also have dimensions optimised for installation of the artificial lawn.

Thus it will be easy to adapt (enlarge, reduce or repair) the artificial lawn.

By making the substrate elements interconnectable, using suitable connecting means, the time required for installing the artificial lawn is reduced. The use of a jigsaw-shaped connecting element, for example, provides the advantage of a quick installation and a strong construction. It is also possible, however, to use other connecting methods or connecting elements that are known per se.

The invention will now be explained in more detail with reference to a drawing, in which:

FIG. 1 schematically shows an embodiment of a prior art artificial lawn;

For a better understanding of the invention, like parts shown in the various figures will be indicated by the same numerals in the description of the figures below.

Figure 1:
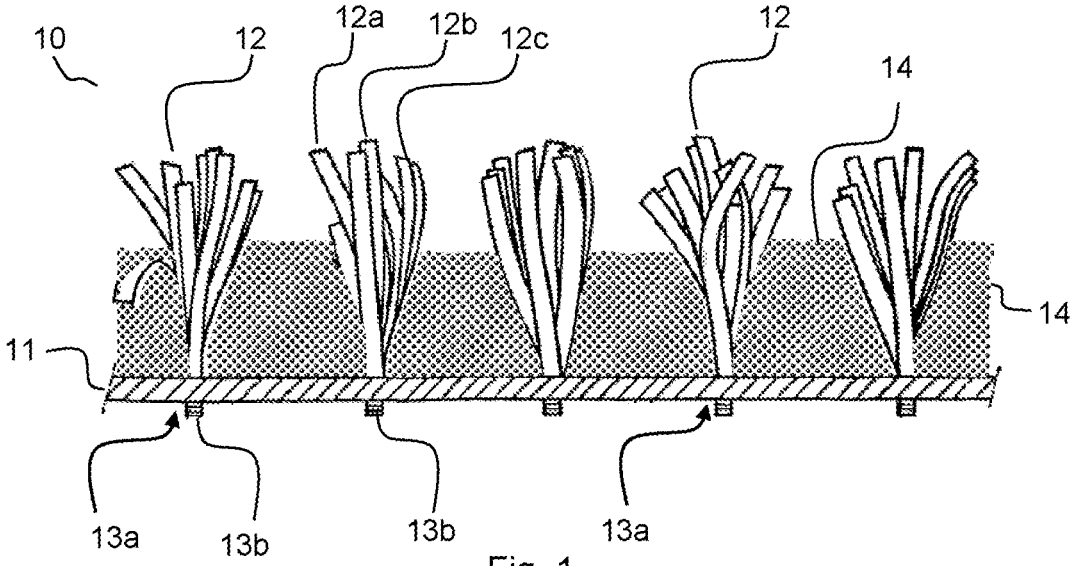

FIG. 1 shows an embodiment of an artificial lawn according to the prior art. The artificial lawn 10 shown in FIG. 1 comprises a substrate 11 and several artificial grass fibres 12. Each of the artificial grass fibres 12 consists of a bundle of fibres, indicated at 12*a*, 12*b* and 12 in the figure. Said fibres 12*a*, 12*b*, 12*c* may be twined together, for example. The artificial grass fibres 12 have been attached to the substrate 11 by means of a tufting or weaving technique.

Provided between the artificial grass fibres 12 is a granular infill material 14, in this figure indicated, merely by way of illustration, as a multitude of little balls (shown on a larger scale). Such granular infill material, also referred to as "infill", may consist of one type of material, such as sand, rubber or coconut fibre, but it may also be made up of a combination of materials so as to obtain specific characteristics of the artificial lawn.

The infill 14 has a versatile function. In the first place it functions as a damping material during play. As a result, the artificial lawn will have a softer and thus more natural feel. In the second place, the infill 14 functions to support the artificial grass fibres 12 in order to prevent the fibres from being trampled flat during play.

Figure 2:
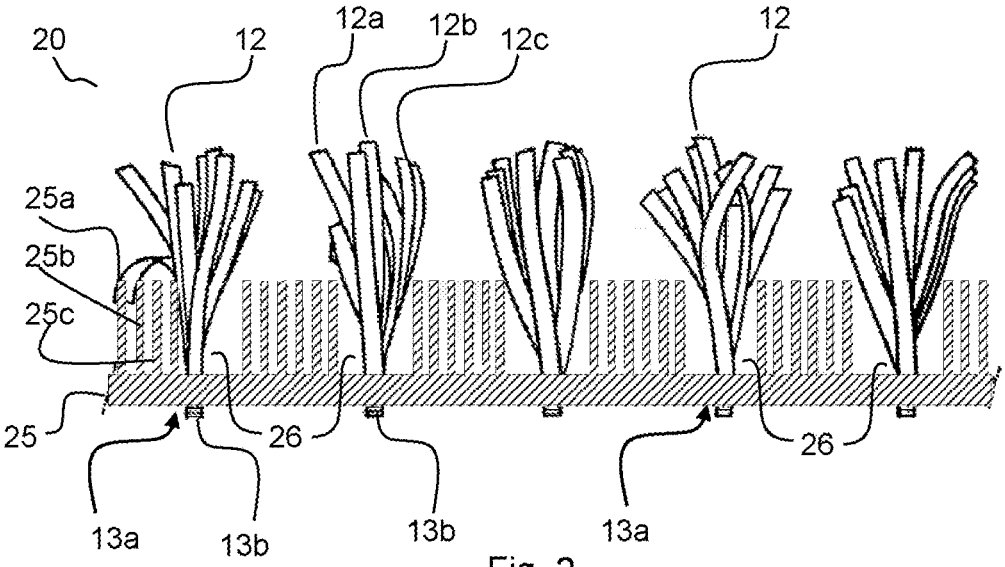
FIGS. 2-4 show various embodiments of an artificial lawn comprising a substrate according to the invention.

FIG. 2 shows an embodiment of an artificial lawn according to the invention. The artificial lawn 20 shown in FIG. 2 comprises a substrate 25 and several artificial grass fibres 12. Each of the artificial grass fibres 12 consists of, for example, a bundle of filaments and/or tape yarns, indicated at 12*a*, 12*b* and 12*c* in the figure. Said artificial grass fibres are, in principle, not different from the artificial grass fibres used in prior art artificial lawns. The substrate is configured differently, however.

In contrast to the prior art substrate 11, the substrate 25 according to the invention comprises parts 25*a*, 25*b* and 25*c* projecting towards the free ends of the artificial grass fibres. Said projecting parts or protrusions 25*a*, 25*b* and 25*c* extend between and along the artificial grass fibres 12 and have a length (or height) which is at most equal to the length of the artificial grass fibres 12 that are used. As FIG. 2 shows, the protrusions 25*a*, 25*b* and 25*c* form part of the substrate 25 and thus do not form separate elements that must somehow be connected to the substrate. The substrate at least partially replaces the damping function of the infill. In a practical embodiment, however, a limited amount of infill may be used. A layer thickness of between 0.5 and 1.5 cm may be considered in that regard.

Using various techniques, artificial grass fibres 12 may subsequently be provided at free position 26 in the substrate 25 and between the protrusions 25*a*-25*b*-25*c*. Usually, the artificial grass fibres 12 are provided through the substrate 25 (for example by means of a tufting technique), where they are attached to the underside 25*a* (on the first side) of the substrate 25 at points of attachment 13*a*. At said points of attachment 13*a*, artificial grass loops 13*b* may be formed, for example upon tufting the artificial grass fibres into the substrate. At said points of attachment, the artificial grass fibres 12 may also be inserted into the substrate, for example, or be provided in the substrate in any other way, whereupon the artificial grass fibres are bonded to (melted together with) the substrate, for example by means of an ultrasonic welding technique.

Another way of attaching the artificial grass fibre loops 13*b* to the substrate is by means of a powder coating technique. In powder coating, a layer of powder is sprayed on the underside of the substrate 25, which layer is subsequently melted together with the substrate 25 so as to realise a durable bond of the artificial grass fibres to the substrate.

Figure 3:
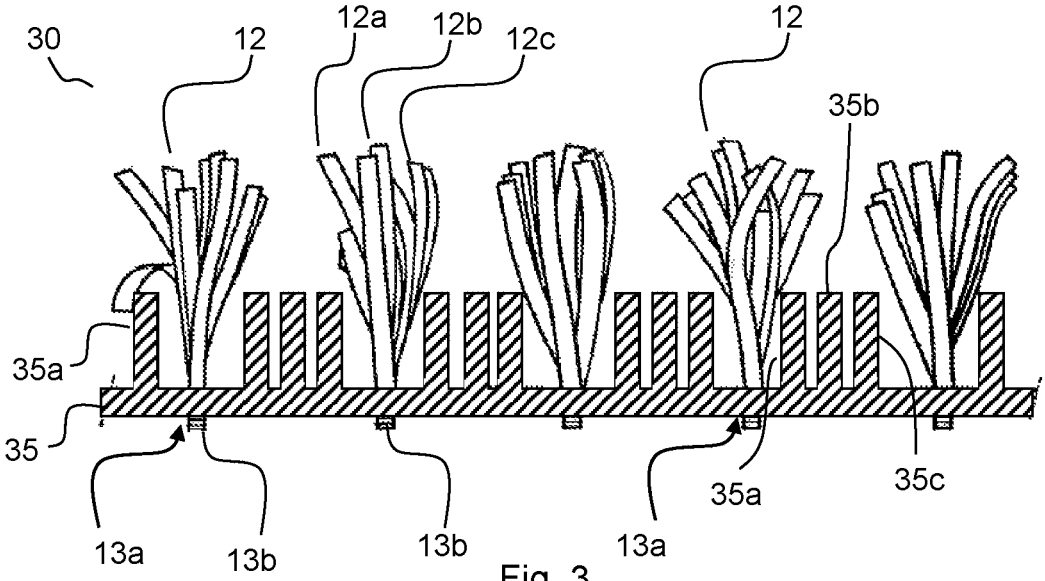

FIG. 3 shows an artificial lawn 30 in which the substrate 35 is provided with protrusions 35*a*, 35*b* and 35*c* which have a cross-sectional area larger than that of the protrusions shown in FIG. 2. Depending on the desired damping effect, or generally depending on the extent to which the playing characteristics of the artificial lawn in question are to be influenced, the dimensions (height or cross-section) and shape of the protrusions can be varied.

Figure 4:
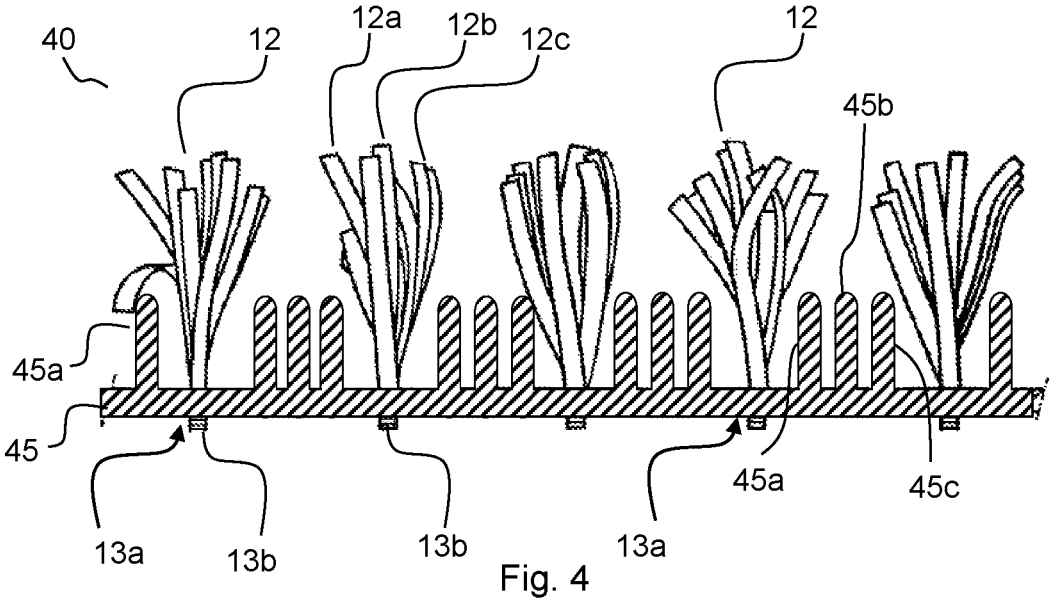

Thus, the protrusions may have a round but also an ellipsoidal or polygonal cross-section, depending on the desired characteristics of the artificial lawn. As is shown in FIG. 4, the protrusions 45*a*, 45*b* and 45*c* have rounded free ends in this embodiment, whilst the protrusions shown in FIGS. 2 and 3 have an angular shape. Rounded free ends reduce the risk of injury and can further influence the playing characteristics, for example the bouncing behaviour of a game attribute (a ball, a rugby ball, etc).

The characteristic properties of the protrusions (height, shape and diameter) may differ at different locations in the artificial lawn. After all, not all locations/areas of an artificial lawn are played on with the same intensity. In the case of a soccer match, for example, the area around the centre spot and the goal area are often played on more intensively than other areas in the field (along the lines and in the corners). The substrate, and in particular the protrusions, may different as regards configuration and dimensions at these locations.

By producing the substrate from a thermoplastic material, its production will be relatively simple and inexpensive. The addition of a material having elastomeric properties enhances the damping characteristics of the substrate. Various compositions of materials can be used to obtain optimum material properties (and thus playing characteristics).

Attaching the artificial grass fibres 12 to the substrate results in projecting parts of artificial grass fibre loops 13*b* analogous to FIG. 2. Said projecting parts have several drawbacks. The artificial grass fibre loops 13*b* lead to a difference in height, which may or may not be small, as a result of which said artificial grass fibre loops can break due to interaction (friction/abrasion) with the sport-technical base, so that the fibres 12 will be loosely held in the substrate and can more easily become detached, therefore.

Figure 5:
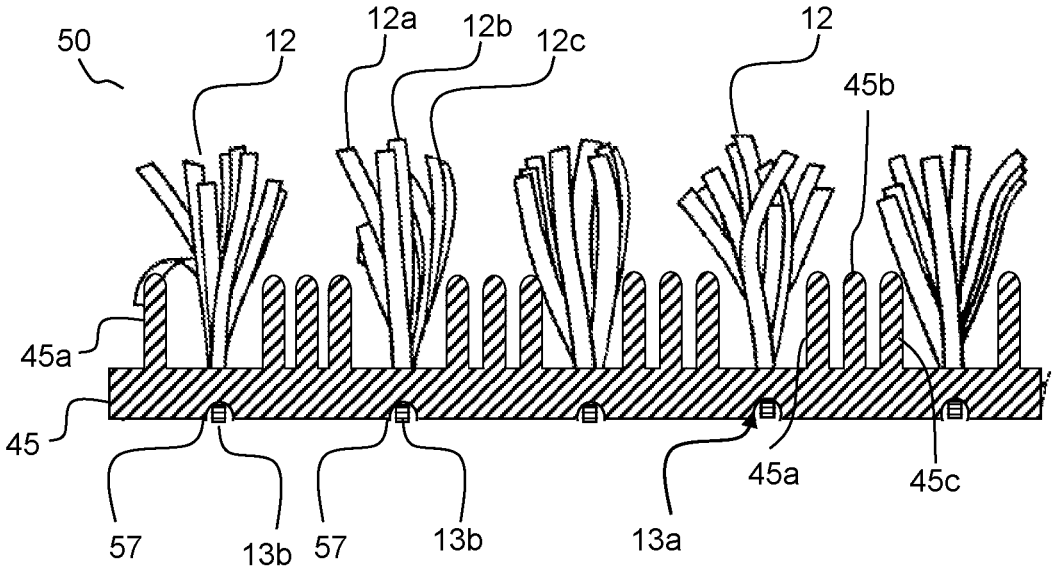
FIG. 5 shows an embodiment of an artificial lawn comprising artificial grass fibre connections that are recessed in the substrate.

Secondly, the presence of the artificial grass fibre loops leads to unevennesses in the field, which adversely affects the playing characteristics. To obviate such drawbacks, the artificial lawn 50 as shown in FIG. 5 is provided with recesses artificial grass fibre loops 13*b*. The substrate 45 is provided with cavities or recesses 57 at the location of the artificial grass fibres 12, which cavities or recesses partially extend into the substrate 45 and which are sufficiently deep for accommodating the artificial grass fibre loops 13*b*. The artificial grass fibre loops 13*b* are thus recessed in the substrate to such an extend that the contact surface of the substrate with the sport-technical base is flat.

Figure 6:
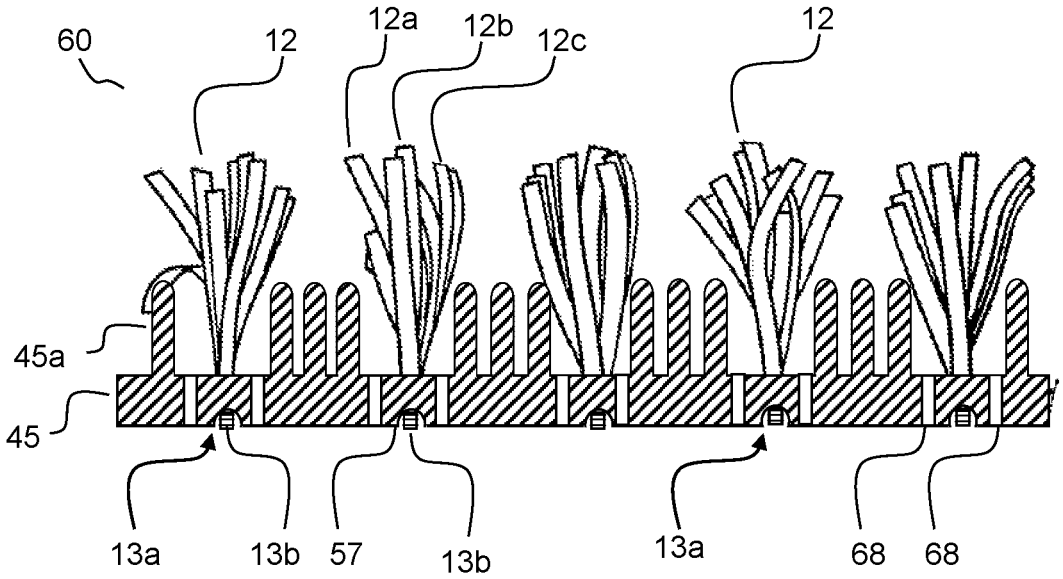
FIG. 6 shows an embodiment of an artificial lawn comprising drainage channels.

The embodiment of the artificial lawn 60 that is shown in FIG. 6 is provided with drainage channels 68 formed in the substrate 45. Said channels 68 extend into the substrate 45 from the side of the free ends of the artificial grass fibres 12. The drainage channels 68 are in this figure represented as channels which extend from the top side to the bottom side, in which connection it is assumed that this enables the rainwater to pass through the substrate to the sport-technical base, where the rainwater can further drain away or be discharged to the side of the lawn.

In another substrate configuration, the drainage channels may in part also be provided horizontally in the substrate 45, so that the water will flow into the substrate 45 from the upper side and is discharged through the substrate 45 to the side of the artificial lawn. In this configuration, there is no need for a drainage system in the base, which simplifies the construction of the complete artificial grass system.

Figure 7:
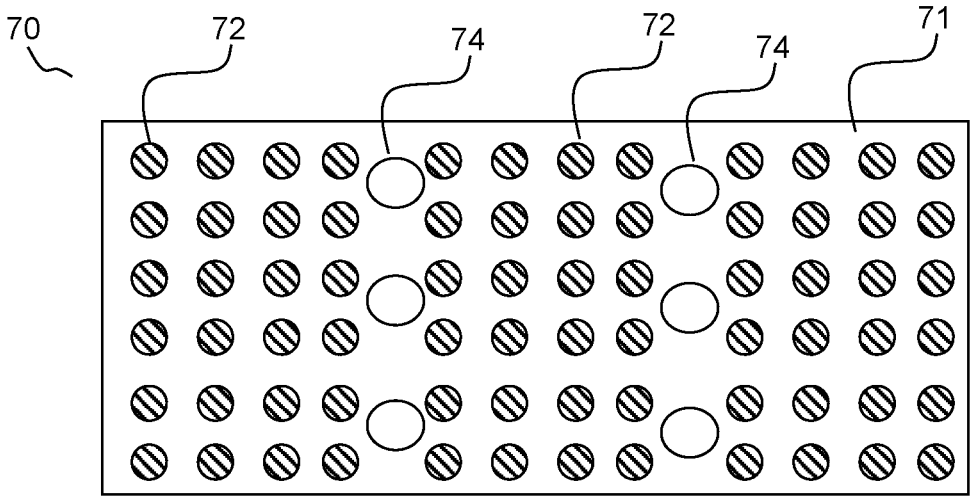
FIGS. 7 and 8 show an embodiment of a substrate element according to the invention.
Figure 8:
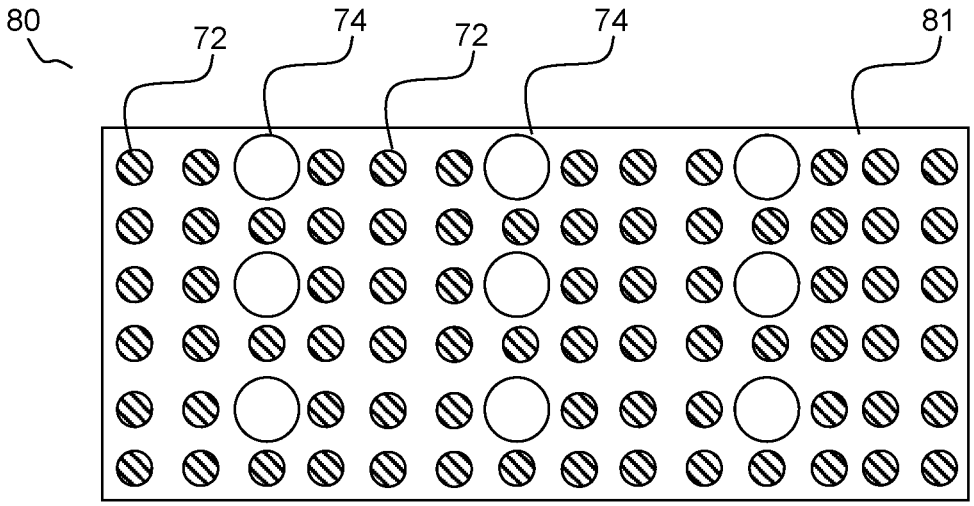

FIG. 7 shows an embodiment of an artificial grass substrate element for putting together an artificial lawn according to the invention. This top plan view of the substrate element 71 shows a multitude of artificial grass fibres 74 as indicated at 12 in FIGS. 1-6. The protrusions of the substrate are indicated at 72 in this figure. FIG. 8 shows another embodiment of an artificial grass substrate element 81, in which the protrusions 72 are distributed over the substrate element in a different configuration. The configurations of the protrusions 72 and the distribution of the artificial grass fibres 74 shown in FIGS. 7 and 8 merely serve by way of illustration, other configurations are also conceivable.

Figure 9:
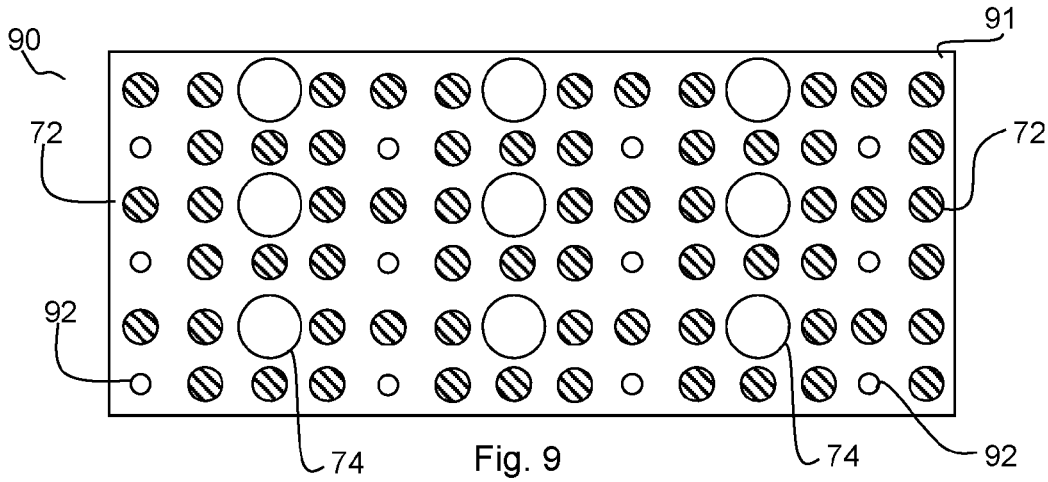
FIG. 9 shows an embodiment of a substrate element provided with the drainage channels.

FIG. 9 shows an embodiment of a substrate element 90, in which several drainage channels 92 for discharging rainwater are present between the artificial grass fibres 74 and the protrusions 72. Depending on the required drainage capacity, a larger or smaller number of drainage channels 92 may be provided in the substrate element 91.

Figure 10:
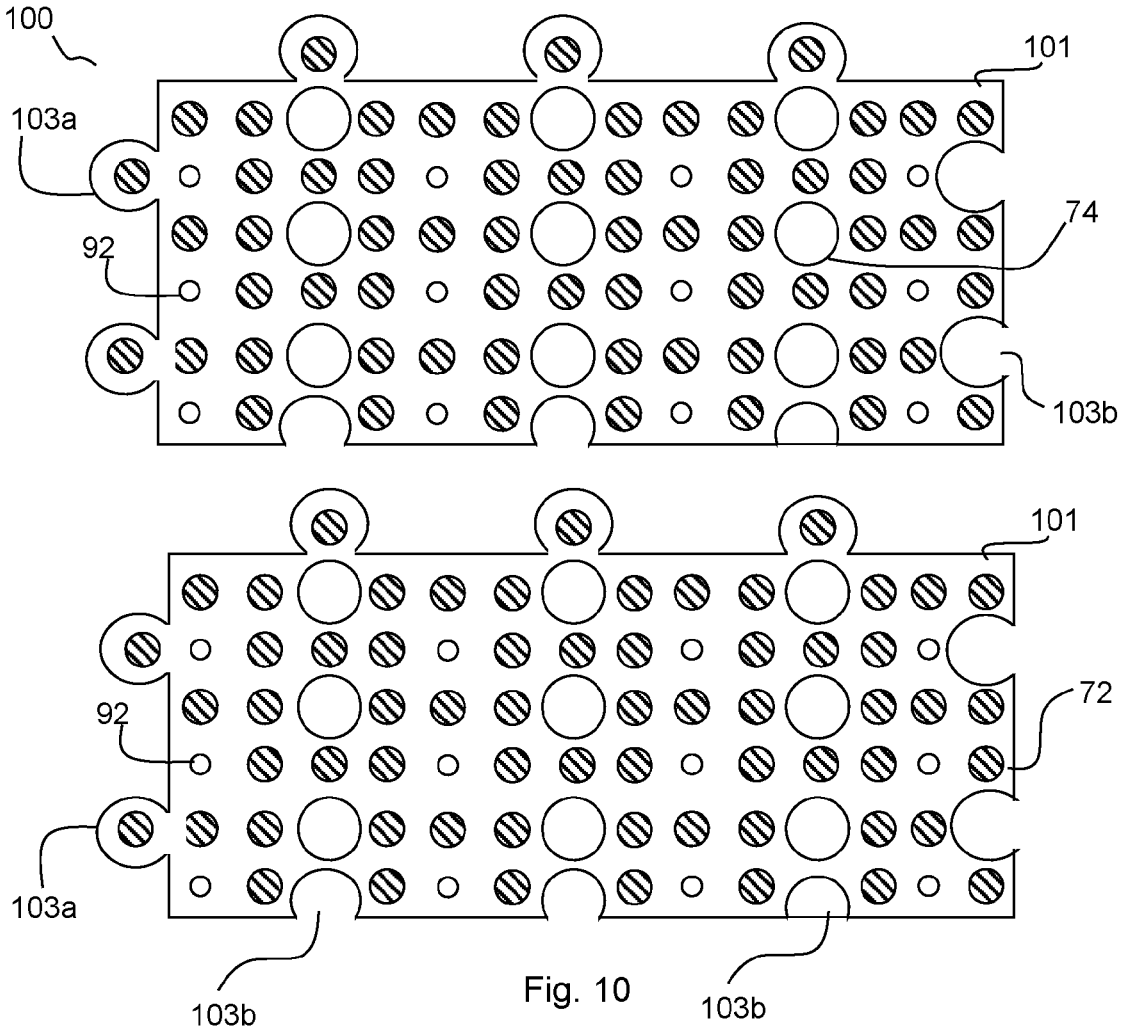
FIG. 10 shows an embodiment of interconnectable substrate elements.

FIG. 10 shows two substrate elements 101, which can be connected together and to further substrate elements (not shown). In this figure, the substrate elements can be connected together by means of mating connecting means 103*a* and 103*b*, although other known connecting techniques (not shown) are also possible. The use of such connecting elements has a positive effect on the speed with which the artificial lawn can be installed. Furthermore, adaptation of the lawn (making it larger or smaller) or maintenance (replacing a substrate element) is easy to carry out.

Figure 11:
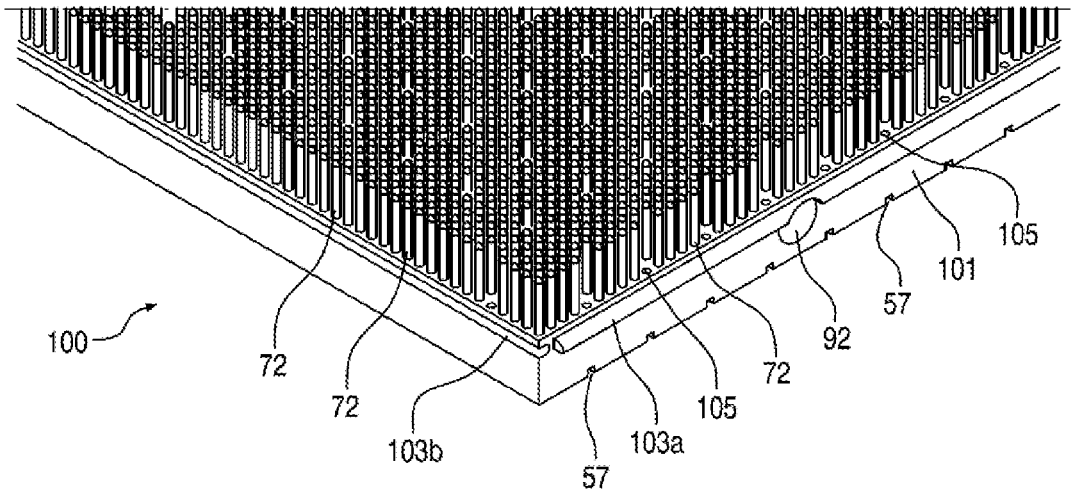
FIGS. 11 and 12 show a practical embodiment of interconnectable substrate elements.
Figure 12:
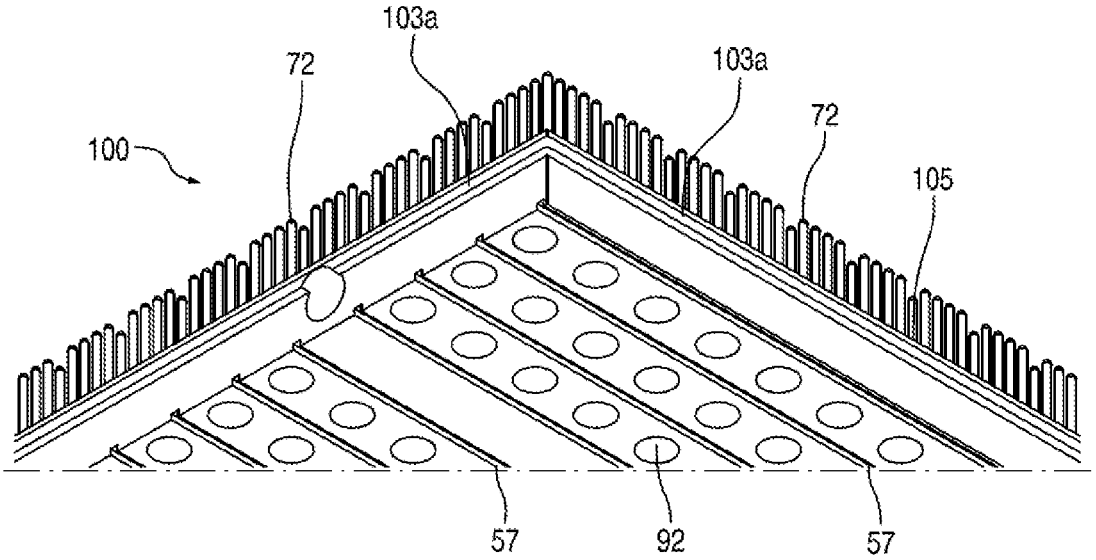

In FIGS. 11 and 12, substrate elements 101 which can be connected together by means of the projecting edges 103*a* and 103*b* are shown from different perspectives. The substrate elements 101 are provided with a multitude of protrusions 72, which project upwards from the substrate element 101 in the form of studs. The artificial grass fibres 12 can be provided between the protrusions 72 in the designated positions 105, for example by means of a tufting technique. The loops formed upon tufting on the underside of the substrate elements fall into the recesses 57, configured as slots in this embodiment, which have been formed in the substrate elements for that purpose. The substrate elements 101 are further provided with a drainage system 92, through which rain water that falls on the artificial grass system can be discharged.

The connection between the substrate elements can be further strengthened after installation by using a glue or other bonding means.

According to the invention it is possible to manufacture the substrate, and in particular the various substrate elements of which the substrate can be formed, by means of the so-called injection-moulding process. This makes it possible to produce the substrate (elements) from various raw materials or raw material mixes. It is conceivable in this connection to produce the integrated "fibres" from a particular raw material or raw material mix and to produce the substrate (elements) to which the fibres are attached from another raw material mix. This makes it possible to produce different versions, for example versions in which the substrate is "stiffer" or "harder" than the fibres, which are made of a softer material in that case.

This moulding technology makes it possible to build up the (in fact solid) substrate (elements) from different layers of material, for example a first embodiment made up of a soft, flexible sublayer, a damping centre layer and a stiff upper layer. Another embodiment may consist of a soft sublayer, so that it can be placed on any base and adapt thereto, and a stiff upper layer on top thereof. In yet another embodiment, the substrate (elements) consist(s) of a solid sublayer made of one material, whilst the protrusions are made of one or more other materials.

In yet another manufacturing method, a raw (possibly gas-foamed) starting material, such as polyurethane (PU) or, alternatively, a polyolefin material (such as PP or PE) may be used, which material is injection-moulded, whilst the artificial grass fibres may simultaneously be integrated. In this injection moulding technique the material may be moulded directly in the form of a plate material, from which the substrate elements are obtained.

Possibly, an extrusion technique may be used, in which plates are extruded and processed into substrate elements. Using a milling or drilling technique, the protrusions, the openings and the slots can subsequently be formed in the substrate material in the form of a matrix. Alternatively, plates may be extruded, whereupon the shape (protrusions and the like) are pressed into the plastic material, which is still deformable at that stage.

The invention claimed is:

1. An artificial lawn comprising:

a substrate; and a plurality of artificial grass fibres extending from the substrate and comprising free ends, wherein the substrate comprises elongate protrusions formed integrally with the substrate and that extend upwardly from the substrate between and along the plurality of artificial grass fibres, wherein both the substrate and the protrusions are formed of gas-foamed material.

2. The artificial lawn of claim 1, wherein the substrate has a first side, to which the plurality of artificial grass fibres are attached at attachment locations, and a second side, from which the protrusions extend in the direction of the free ends of the plurality of artificial grass fibres.

3. The artificial lawn of claim 1, wherein the plurality of artificial grass fibres are tufted into the substrate.

4. The artificial lawn of claim 1, wherein the plurality of artificial grass fibres are bonded to the substrate via ultrasonic welding.

5. The artificial lawn of claim 1, wherein the plurality of artificial grass fibres are bonded to the substrate via powder coating.

6. The artificial lawn of claim 2, wherein the protrusions have a round cross-section.

7. The artificial lawn of claim 6, wherein the round cross section is a cylindrical or ellipsoidal cross section.

8. The artificial lawn of claim 2, wherein the protrusions comprise a cross-section and wherein the cross-section of the protrusions is polygonal in shape.

9. The artificial lawn of claim 2, wherein the free ends of the protrusions are rounded.

10. The artificial lawn of claim 1, wherein the gas-foamed material comprises a polymer.

11. The artificial lawn of claim 10, wherein the polymer is a thermoplastic, an elastomer or a thermoplastic elastomer.

12. The artificial lawn of claim 2, wherein the substrate comprises recesses provided on the substrate at the attachment locations.

13. The artificial lawn of claim 1, wherein the substrate comprises drainage channels extending through the substrate for the drainage of water from the artificial lawn.

14. The artificial lawn of claim 1, wherein the substrate comprises a plurality of interconnectable substrate elements.

15. The artificial lawn of claim 14, wherein each substrate element comprises connectors, wherein the connectors of one of the substrate elements mates with corresponding connectors from another of the substrate elements.

16. The artificial lawn of claim 1, wherein the plurality of artificial grass fibres are provided along the substrate in a plurality of parallel rows, wherein adjacent parallel rows are separated by a distance, wherein the elongate protrusions extend between and along adjacent parallel rows, and wherein a plurality of elongate protrusions are provided across the distance between adjacent parallel rows.

17. The artificial lawn of claim 1, wherein the artificial lawn is an artificial grass sports field.

18. A substrate element for forming an artificial lawn according to claim 1.

19. A method for forming an artificial lawn, comprising:

i) integrally-forming a substrate with elongate protrusions extending upwardly from the substrate, wherein the substrate and elongate protrusions comprise a gas-foamed material; and ii) attaching a plurality of artificial grass fibres to the substrate such that the plurality of artificial grass fibres extend from the substrate between and along the elongate protrusions.

20. A device for producing a substrate element for forming an artificial lawn in accordance with claim 19.

* * * * *